US006370858B1

(12) United States Patent
Mori

(10) Patent No.: US 6,370,858 B1
(45) Date of Patent: Apr. 16, 2002

(54) CORE YARN PRODUCTION METHOD AND APPARATUS

(75) Inventor: Shigeki Mori, Otsu (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 0 days.

(21) Appl. No.: 09/685,557

(22) Filed: Oct. 11, 2000

(30) Foreign Application Priority Data

Dec. 13, 1999 (JP) ..... 11-352822

(51) Int. Cl.[7] ..... D01H 1/115; D01H 7/02

(52) U.S. Cl. ..... 57/6; 57/5; 57/12; 57/17; 57/350; 57/908

(58) Field of Search ..... 57/6, 12, 13, 5, 57/224, 350, 908

(56) References Cited

U.S. PATENT DOCUMENTS 3,822,543 A * 7/1974 Edagawa et al. ..... 57/106
4,450,675 A * 5/1984 Petrov et al. ..... 57/6
5,568,719 A * 10/1996 Proctor ..... 57/225
6,240,716 B1 * 6/2001 Yanagawase et al. ..... 57/210

FOREIGN PATENT DOCUMENTS

JP 02-713089 10/1997

* cited by examiner

*Primary Examiner*—Andy Falik
(74) *Attorney, Agent, or Firm*—Armstrong, Westerman & Hattori, LLP

(57) ABSTRACT

A method and apparatus for producing core yarn in which a drafted fiber bundle and a core fiber are supplied to a nozzle block and a hollow guide shaft, and in which vortex air currents are ejected from spinning nozzles, in the nozzle block, to make the fiber bundle wrap around the core fiber evenly and uniformly.

7 Claims, 4 Drawing Sheets

CORE YARN PRODUCTION METHOD AND APPARATUS

FIELD OF THE INVENTION

The present invention relates to a method of producing core yarn resembling true twist spun yarn and an apparatus that employs such a method. In this method, vortex air currents ejected from spinning nozzles embedded in a nozzle block are applied to a drafted fiber bundle fed to the entrance of a hollow guide shaft. This results in the fibers of the fiber bundle turning inversely. These inversely turned fibers wrap the fiber bundle while it is being fed into the hollow guide shaft.

BACKGROUND OF THE INVENTION

The Japanese Patent Publication No. 2713089 discloses a core yarn production method using true twist spinning. In this method, a drafted fiber bundle and a core fiber are supplied to a nozzle block and to a hollow guide shaft. The fiber bundle receives vortex air currents generated by spinning nozzles embedded in the nozzle block, and wraps helically around the core fiber. This method allows true twist spinning to produce core yarn. The core fiber of the core yarn produced with this spinning method is not exposed and the core yarn is resistant to abrasion.

In this method, however, the core fiber is supplied directly to the nozzle block downstream of a front roller in a drafting device. This fluctuates the tension of the core fiber, and the position of the core fiber in the core yarn becomes unstable. As a result, the fiber bundle does not uniformly wrap the core fiber and the quality of the core yarn is not always uniform. In other words, the problem is that when the core fiber is supplied directly to a spinning zone, the tension and the position of the core fiber are unstable. As a result, the core fiber may not always be unexposed or may not be very resistant to abrasion.

In addition, when core yarn is produced in a true twist spinning method, it is desired that the core yarn should have elasticity. Ordinary filament yarn used as core fiber does not have much elasticity.

It is thus an object of the present invention to provide a method to allow even wrapping of a fiber bundle around core fiber, to improve uniformity of the quality, and also to improve elasticity of the core yarn in a true twist spinning method where a drafted fiber bundle and core fiber are supplied to a nozzle block and a hollow guide shaft.

SUMMARY OF THE INVENTION

In a first aspect of the present invention, in a spinning method in which a drafted fiber bundle is supplied to a nozzle block and then to a hollow guide shaft, and in which vortex air currents ejected from spinning nozzles of the nozzle block to an area adjacent to the upper tip of the hollow guide shaft allow inversely turned fibers to wrap the fiber bundle that is being fed into the hollow guide shaft, a core fiber is supplied upstream of a front roller of a drafting device. Both of the core yarn and the drafted fiber bundle can be fed together to the nozzle block and then to the hollow guide shaft. The vortex air currents allow the inversely turned fibers to wrap around the core fiber and the fiber bundle to create core yarn.

In a second aspect of the present invention, the core fiber is multi-filament. The vortex air currents balloon the multiple filaments, resulting in each filament separated. The vortex air currents also serve to insert the front ends of the fibers into the clearances between the separated filaments, letting the other ends of the fibers wrapping around the multi-filament core fiber, thus resulting in the creation of the core yarn.

In a third aspect of the present invention, the core fiber is elastic.

In a fourth aspect of the present invention, nozzles that eject high-pressure air are embedded along a yarn path to eject high-pressure air, resulting in the suction of the core fiber into the hollow guide shaft.

In a fifth aspect of the present invention, in a spinning apparatus provided with a hollow guide shaft in which a yarn path is embedded and with a nozzle block containing spinning nozzles that eject vortex air currents to an a area adjacent to the entrance of the hollow guide shaft, a core fiber is fed upstream of a front roller through a core fiber supplying device, and then a fiber bundle and the core fiber are guided to the nozzle block and the hollow guide shaft. In an area adjacent to the entrance of the hollow guide shaft, fibers that make up the fiber bundle wrap around the core fiber to create core yarn.

In a sixth aspect of the present invention, the core fiber supplying device is provided with a delivery roller that rotates positively while contacting an elastic yarn package, and designed to be an elastic yarn supplying device.

In a seventh aspect of the present invention, the nozzles to eject high-pressure air are embedded along the yarn path.

DETAILED DESCRIPTION OF THE PREFERRED EMBODIMENTS

Embodiments of the present invention will now be explained with reference to the accompanying drawings.

Figure 1:
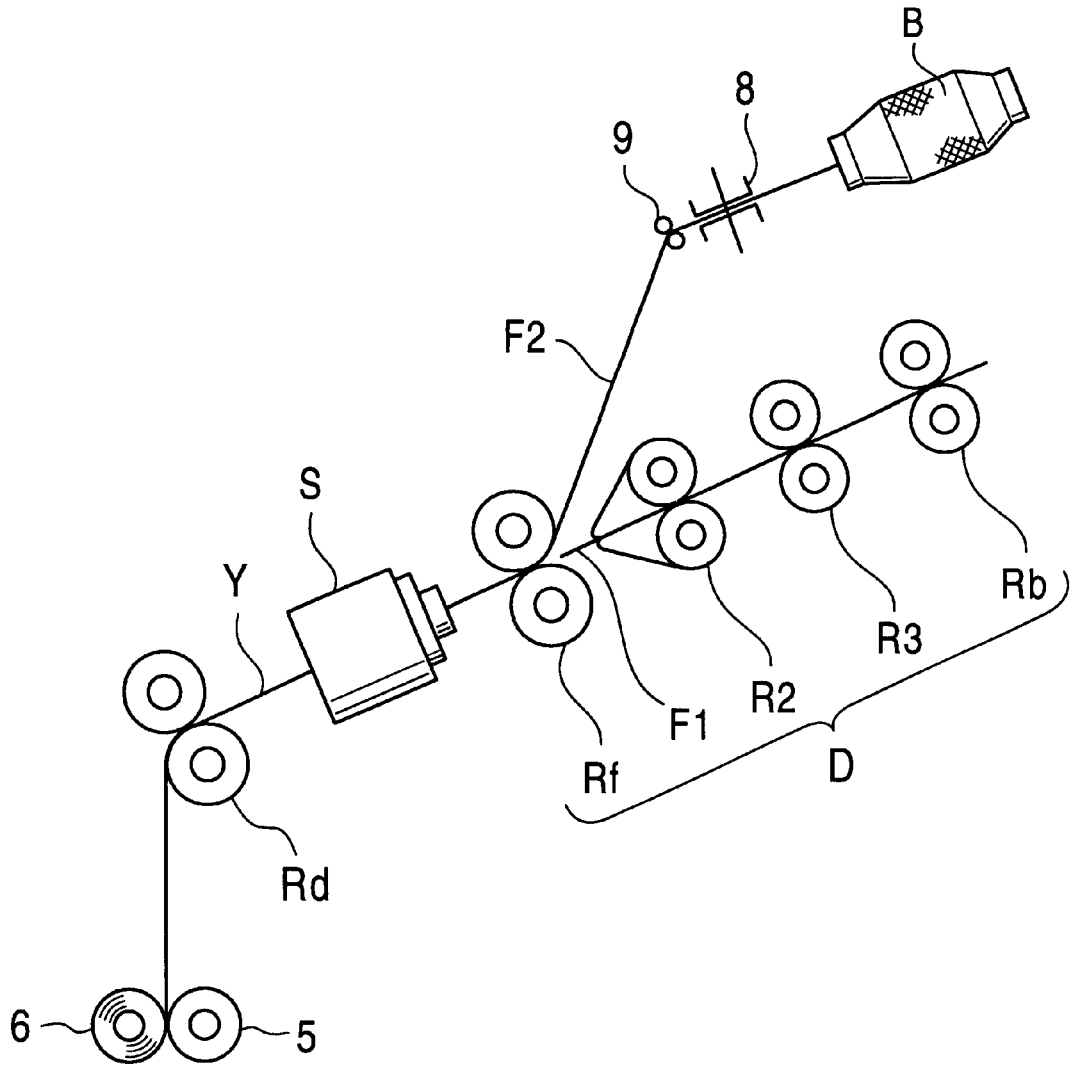
FIG. 1 is a schematic view of the preferred embodiment of the present invention.

FIG. 1 shows a core yarn producing apparatus related to the present invention to create a core yarn Y wherein covering fibers wrap the core fiber. The apparatus has a drafting device D and a spinning device S that is placed downstream of the drafting device D. The drafting device D is composed of a front roller Rf, a second roller R2 that has aprons, a third roller R3, and a back roller Rb. The fiber bundle F1 is fed upstream of the back roller Rb, drafted, and fed out from the front roller Rf.

Figure 2:
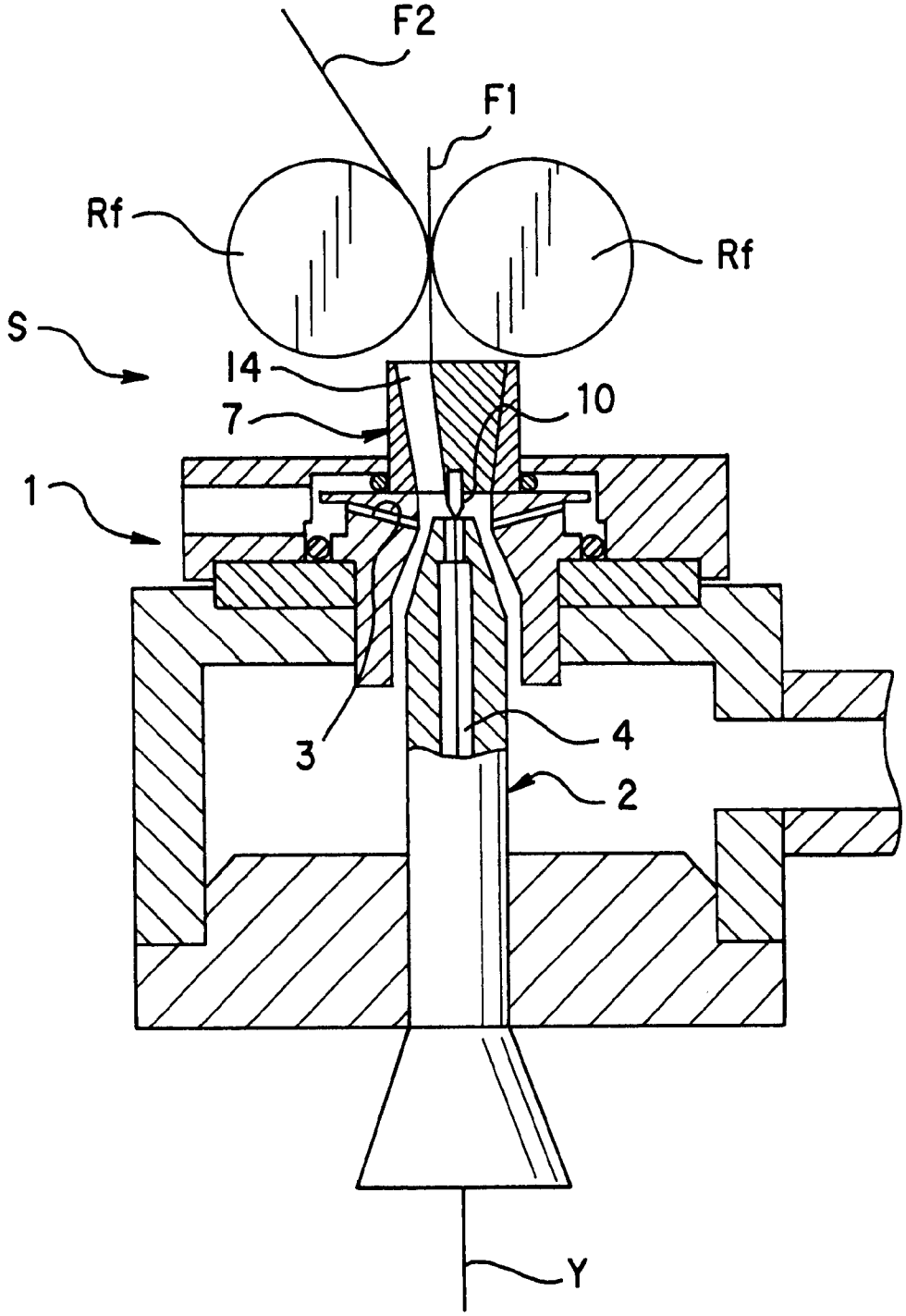
FIG. 2 is a cross-sectional view of the spinning device of the apparatus as shown in FIG. 1.

As is shown in FIG. 2, the spinning device S is composed of a nozzle block 1 and a hollow guide shaft 2. In the spinning device S, the drafted fiber bundle F1 and the core fiber F2 are fed to the nozzle block 1 and the hollow guide shaft 2. The nozzle block 1 contains spinning nozzles 3. The fiber bundle F1 receives at the entrance of the hollow guide shaft 2 the vortex air currents from the spinning nozzles 3, and then is guided to a yarn path 4 of the hollow guide shaft 2 while wrapping around the core fiber F2. As a result, true twist spinning is applied and the core yarn Y is produced. The produced core yarn Y is guided to a winding drum 5 through a delivery roller Rd, and then wound up in a package 6 that rotates while contacting the winding drum 5. The yarn structure of the core yarn Y depends on the ratio of the periphery velocity of the delivery roller Rd to the front roller Rf periphery velocity. In other words, it is determined by the extent of expansion in the area containing the spinning device S. Normally, the periphery velocity ratio of the delivery roller Rd to the front roller Rf is 0.9 to 1.1.

The core fiber F2 fed to the nozzle block 1 and the hollow guide shaft 2 is usually multi-filament and is composed of filaments which are not twisted. The core fiber F2 is derived from a bobbin B, and goes through a tenser 8 and a yarn guide 9 and is fed upstream of the front roller Rf (between the front roller Rf and the second roller R2). Thus the core fiber F2, which is fed together with the fiber bundle F1, goes through the front roller Rf of the drafting device D, and guided to the nozzle block 1 and the hollow guide shaft 2, keeping the tension determined by the periphery velocities of the front roller Rf and the delivery roller Rd.

In the present true twist spinning method, the fiber bundle F1 that wraps around the core fiber F2 is twisted in the way that allows increased intensity of the twist toward the center. Therefore, once the position of the core fiber F2 is deviated from the set axis, the core fiber F2 of the core yarn Y deviates from the center of the core yarn Y, and there may be some possibility of creating a part where only the loosely twisted fiber bundle F1 wraps around the core fiber F2. However, the core fiber F2 is fed to the nozzle block 1 and the hollow guide shaft 2 after the front roller Rf holds it, just as the fiber bundle F1. Therefore, in the area containing the spinning device S, the tension of the core fiber F2 does not change, and stays within the value determined by the periphery velocities of the delivery roller Rd and the front roller Rf. The position of the core fiber F2 is stable on the set axis at the entrance of the hollow guide shaft 2. As a result, the core fiber F2 is wrapped uniformly by the fiber bundle F1. The quality of the core yarn Y stays uniform. When cloth is produced from the core yarn Y, there will be no uneven dyeing even if only the covering fiber bundle F1 is dyed.

The principle of spinning is as follows.

The upper ends of the fibers that compose the fiber bundle F1 turn inversely at the entrance of the hollow guide shaft 2 because of the vortex air currents from the spinning nozzles 3. These fibers that turn inversely are called inversely turned fibers. These inversely turned fibers wrap around the core fiber F2 and the fiber bundle F1 that are running as they are being fed into the hollow guide shaft 2. These inversely turned fibers are constantly being generated and wrap around the core fiber F2 to produce the core yarn Y wherein the core fiber F2 is not exposed and the surface is completely covered by wrapping fibers. In the present embodiment, the tension of the core fiber F2 in the area where spinning is applied is stable, stabilizing the balloon that is made by the vortex air currents ejected from the spinning nozzles 3. Therefore, the multiple filaments that make up the core fiber F2 are evenly separated from each other all along the length of the fiber. In turn, the front end of each of the inversely turned fibers is inserted into the clearances between the filaments. The other ends of the inversely turned fibers wrap around to produce the core yarn Y that is uniform in quality and resistant to abrasion all along the length of the yarn.

In the present embodiment, the tension of the core fiber F2 is maintained by the tenser 8 regardless of the unwinding condition of the bobbin B, so that the position of the core fiber F2 is stable at the entrance of the hollow guide shaft 2. The fiber bundle F1 that comes out of the drafting device D is guided through a fiber guiding hole 14 of a fiber guiding component 7 of the nozzle block 1 and goes into the hollow guide shaft 2. In addition, a needle 10 is mounted in the nozzle block 1. The needle 10 is mounted on the same axis of the yarn path 4. The needle 10 guides the fibers from the guiding hole 14 to the entrance of the hollow guide shaft 2, prevents the false twist from spreading toward the front roller Rf by curbing the balloon, and enhances the reversal of the fibers at the entrance of the hollow guide shaft 2. The needle 10 helps stabilize the position of the core fiber F2 in the yarn path 4 because the fibers run along the needle 10. As a result, the improved core yarn Y can be produced, whose wrapping fibers are more evenly distributed. However, even without the needle 10, the core fiber F2 can guide the fibers along to the yarn path 4 of the hollow guide shaft 2.

The present embodiment comprises the nozzle block 1 provided with spinning nozzles 3, and the hollow guide shaft 2 with the yarn path 4 made on the axis of the shaft center. The fiber bundle F1 and the core fiber F2 are together fed from the fiber guiding hole 14 of the nozzle block 1. The vortex air currents ejected from the spinning nozzles 3 to the entrance of the hollow guide shaft 2 enables the upper ends of the fibers that make up the fiber bundle F2 to turn inversely. The inversely turned fibers wrap around the core fiber F2 while wrapping around the outer surface of the upper part of the hollow guide shaft 2. This method can produce the core yarn Y wherein the core fiber F2 is uniformly wrapped up by the covering fibers all along the length of the yarn.

Figure 3:
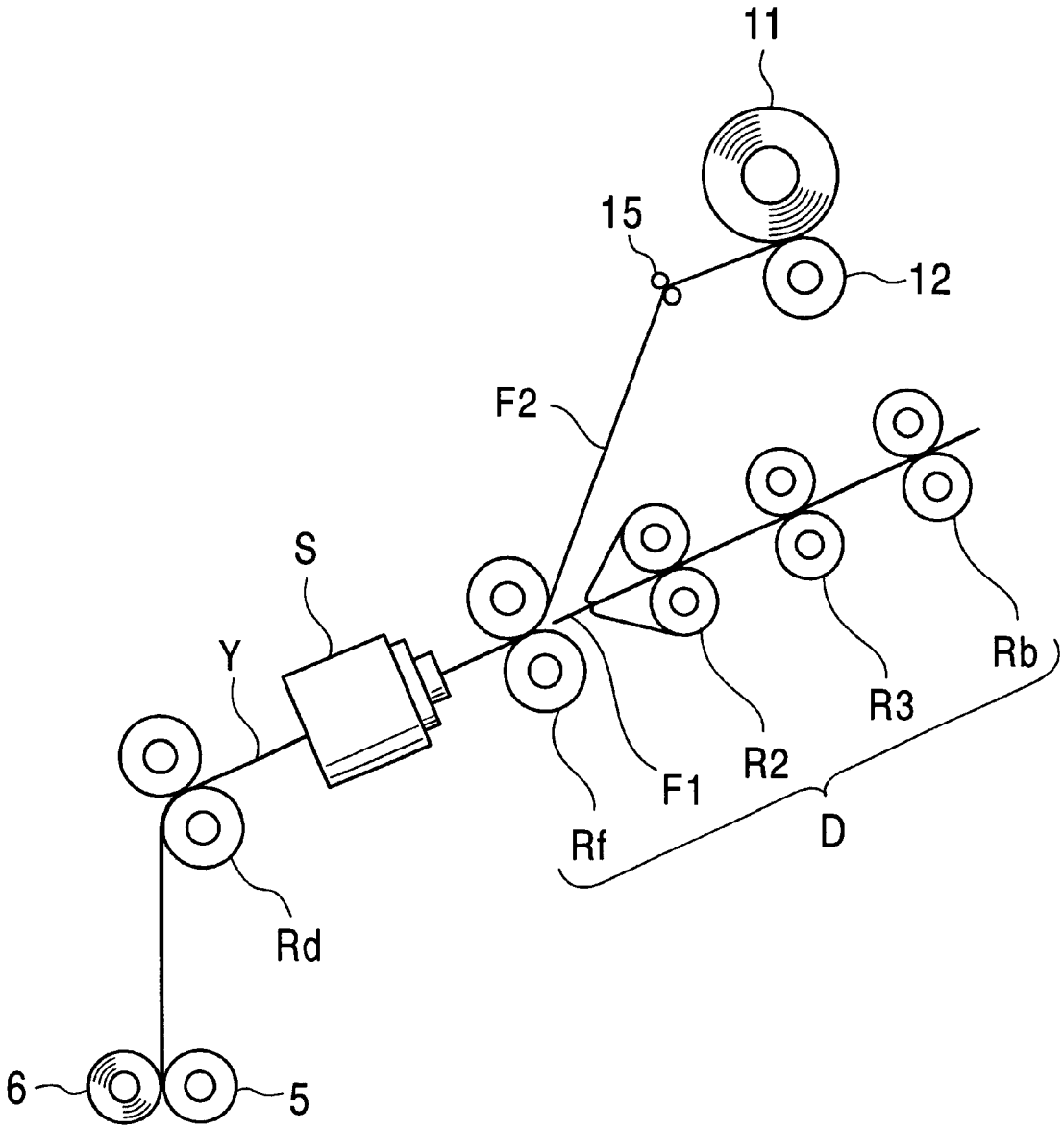
FIG. 3 is a schematic view of the another embodiment of the present invention, where an elastic yarn is used as the core fiber.

FIG. 3 illustrates another embodiment. In the present embodiment, the core fiber F2 which is made of elastic yarn is fed from an elastic yarn supplying device. The elastic yarn supplying device comprises a package 11 that has wound up the elastic yarn and a delivery roller 12 that rotates positively, contacting the package 11. The package 11 rotates along with the delivery roller 12, feeding the core fiber F2. The core fiber F2 goes through a yarn guide 15 and is fed upstream of the front roller Rf of the drafting device D (between the front roller Rf and the second roller R2, and is guided to the nozzle block 1 and the hollow guide shaft 2. The yarn guide 15 feeds the core fiber F2 made of elastic yarn from upstream of the front roller Rf. As in the embodiment illustrated in FIG. 1, the fiber bundle F1 receives at the entrance of the hollow guide shaft 2 vortex air currents from the spinning nozzles 3 and wraps the core fiber F2 helically. This results in true twist spinning to create the core yarn Y. Further, the delivery roller 12 is positively driven by an inverter and a motor. The periphery velocity of the delivery roller 12 is set slower by a set rate than that of the front roller Rf. Therefore, the elastic yarn is elongated at a set rate between the front roller Rf and the delivery roller 12, which is mounted upstream. The rate is usually set at three to four. The elongation of the core yarn Y that contains the core fiber F2 can be determined by the rate. The structure of the core yarn Y is determined by the ratio of the periphery velocity of the delivery roller Rd to the velocity of the front roller Rf. The ratio is usually set at 0.9 to 1.1. A yarn detecting sensor between the delivery roller 12 and the front roller Rf could detect the feeding errors of the elastic yarn.

In the present embodiment illustrated by FIG. 3, the structure of the core yarn Y that is true twist spun is the same as the core yarn produced in the embodiment illustrated by FIG. 1. However, the core fiber F2 is elastic yarn such as spandex. As a result, the core yarn Y has greater elasticity. In order to stabilize the spinning tension within the nozzle block 1, feeding the core fiber F2 upstream of the front roller Rf of the drafting device D prevents the fluctuation of the tension feeding (the package 11) from affecting the spinning, especially when the core fiber F2 is elastic yarn.

Figure 4:
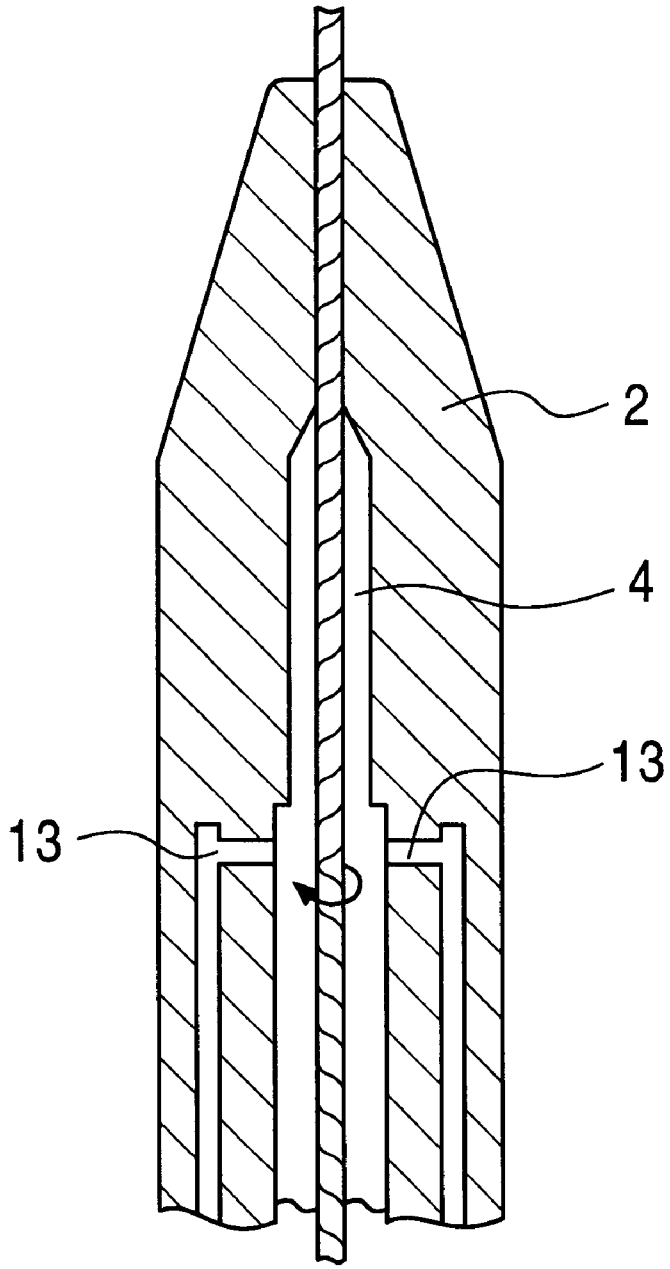
FIG. 4 is a partial cross-sectional view of the hollow guide shaft of the another embodiment.

In the embodiments illustrated in FIG. 1 and FIG. 3, as shown in FIG. 4, the nozzles 13, to eject high-pressure air, which are connected through open and close valves not shown in the drawings to a source of high-pressure air, generate sucking effect within the yarn path 4, while the core fiber F2 is being guided through the yarn path 4 within the hollow guide shaft 2, enabling the core fiber F2 made of filament yarn or elastic yarn to pass through the entrance of the yarn path 4 without curling or clotting. While the nozzles 13 eject high-pressure air, the twist made upstream of the nozzles 13 is in the opposite direction to the twist made downstream, as shown in FIG. 4. The yarn path 4 increases in diameter from the feeding-in position to the feeding-out position. The ejection of high-pressure air from the nozzles 13 generates sucking effect at the feeding position. The nozzles 13 do not work during normal operation (the true twist spinning). The nozzles 13 work for a set period of time to operate a certain task of feeding out the yarn after the yarn is torn, when the feeding-side end and the winding-side end of the yarn should be pieced together. At that time the drafting device D and the spinning nozzles 3 should be resumed. This operation is called starting spinning in contrast to the ordinary true twist spinning. It is desirable that the high-pressure air nozzles 13 generate reversed vortex to the ones generated by the spinning nozzles 3, but non-vortex air currents can work, too.

In the embodiments illustrated in FIG. 1 and FIG. 3, both pure cotton fiber bundle (sliver) and mixed fiber bundle (sliver) of cotton and polyester can be fed to the drafting device D. Different types of wrapping of the covering fibers (fiber bundle F1) around the core fiber F2 can be given to the produced core yarn Y depending on the types of fiber bundles.

One example of core yarn produced by the present invention is such yarn that has the strength of filament yarn as well as the appearance and texture of cotton yarn because of the use of cotton covering fiber. The core fiber of the produced yarn is completely wrapped up by the fiber bundle all along the length of the yarn and the core fiber is not visible from the surface. Feeding the core fiber upstream of the front roller in the drafting device stabilizes the tension and the position of the core fiber through the upstream yarn guide and the front roller . Therefore, if the core fiber is multi-filament, the separation of the filaments become even, assuring and stabilizing the insertion of the tips of the inversely turned fibers into the clearances between the filaments. As a result, the produced core yarn is resistant to abrasion and uniform in quality all along the length of the yarn.

Stabilizing the tension and the position of the core fiber focuses the position of the core fiber in the center of the core yarn. As a result, relatively thicker core fiber to the whole diameter of the core yarn can be used while assuredly preventing the core fiber from being exposed.

Using elastic yarn as core fiber produces such core yarn that is more elastic and more resistant to abrasion, and the core fiber of the core yarn is completely wrapped up and is not exposed. Furthermore, embedding nozzles in the hollow guide shaft to eject high-pressure air creates a sucking effect that can easily pull the core fiber and fiber bundle into the hollow guide shaft at the start of the spinning (starting spinning). This device is especially effective when elastic yarn is used as the core fiber because it is very difficult to feed the core fiber into the hollow guide shaft when the fiber curls up as is often the case with elastic yarn. In addition, the nozzles embedded in the hollow guide shaft can work cooperatively with the spinning nozzles to feed out the core yarn in such a form that allows easy feeding-out by tools such as a suction nozzle from the spinning device at the start of spinning,. As a result, automatic production of core yarn is made possible in a true twist spinning provided with a nozzle block and a hollow guide shaft.

What is claimed is:

1. A core yarn producing apparatus, comprising the following:

a spinning device having a hollow guide shaft provided with a yarn path and spinning nozzles that are embedded in a nozzle block to eject vortex air currents to an area adjacent to an upper tip of the hollow guide shaft; and a core fiber supplying device that feeds a core fiber upstream of a front roller; wherein a drafted fiber bundle and the core fiber are guided to the nozzle block and the hollow guide shaft, and fibers that compose the fiber bundle wrap around the core fiber in an area adjacent to the upper tip of the hollow guide shaft to produce the core yarn.

2. A core yarn producing apparatus according to claim 1 wherein the core fiber supplying device is provided with a delivery roller that is adapted to rotate positively while at the same time contact an elastic yarn package.

3. A core yarn producing apparatus according to claim 1 or claim 2, further comprising nozzles embedded in the hollow guide shaft to eject a high-pressured air in the yarn path of the hollow guide shaft.

4. A core yarn producing method for producing a yarn resembling a true twist spun yarn, comprising:

providing a spinning device with a hollow guide shaft having a yarn path, and a nozzle block including spinning nozzles to eject vortex air currents to an area adjacent to an upper tip of the hollow guide shaft; and supplying a core fiber and a drafted fiber bundle at the same time to the nozzle block and to the hollow guide shaft whereby fibers of the drafted fiber bundle are inversely turned and wrap around the core fiber and the fiber bundle while the core fiber and the fiber bundle are being fed into the hollow guide shaft.

5. A core yarn producing method according to claim 4, in which the core fiber is multifilament, and further comprising:

applying the vortex air currents to the core yarn, which helps balloon the multiple filaments and subsequently separate them from each other;

inserting the tips of the fibers into the clearances between the separated filaments of the core yarn; and making the other ends of the fibers wrap around the multi-filament core fiber to produce core yarn.

6. A core yarn producing method according to claim 4 in which elastic fiber is supplied as the core fiber.

7. A core yarn producing method according to any one of claims 4 to 6 comprising the further step of embedding nozzles inside the hollow guide shaft to eject a high-pressured air in order to give a sucking effect to the yarn path.

* * * * *